United States Patent [19]

Huang et al.

[11] Patent Number: 5,054,691

[45] Date of Patent: Oct. 8, 1991

[54] FUEL OIL INJECTOR WITH A FLOATING BALL AS ITS VALVE UNIT

[75] Inventors: Huei-Huay Huang; Yu-Yin Peng; Tien-Ho Gau, all of Hsin Chu Hsien, Taiwan

[73] Assignee: Industrial Technology Research Institute, Taiwan

[21] Appl. No.: 431,152

[22] Filed: Nov. 3, 1989

[51] Int. Cl.[5] ..... F02M 51/06; F02M 61/18

[52] U.S. Cl. ..... 239/585; 251/129.16; 251/129.21

[58] Field of Search ..... 239/585; 251/129.16, 251/129.18, 129.21

[56] References Cited

U.S. PATENT DOCUMENTS

| | | | |
|---|---|---|---|
| 4,394,973 | 7/1983 | Sauer et al. | 239/585 |
| 4,662,567 | 5/1987 | Knapp | 239/585 |
| 4,711,397 | 12/1987 | Lahiff | 239/585 |

*Primary Examiner*—Andres Kashnikow

*Assistant Examiner*—Karen B. Merritt

*Attorney, Agent, or Firm*—Cushman, Darby & Cushman

[57] ABSTRACT

A solenoid-operated injector for an electronically controlled fuel oil injection system which serves to control fuel oil injection by means of a shift of a ball valve unit. The ball valve unit includes a flat armature and a ball valve, the flat armature is shifted, floatingly, without any guidance. As the ball valve unit is sucked and moved to an open state, the flat armature abuts against a thin plate having a high magnetic resistance. The top of the flat armature is acted upon by a compressed spring with the top end of the compressed spring abutting against a spring regulating tube, so that the spring force acting on the flat armature can be changed by adjusting the spring regulating tube. Both the compressed spring and ball valve are located in the magnetic stator of the solenoid coil with the flat armature and the ball valve being located such that the spring force normally biases the ball valve against the oblique cone concave on the top of the valve seat.

4 Claims, 2 Drawing Sheets

Fig. 1.
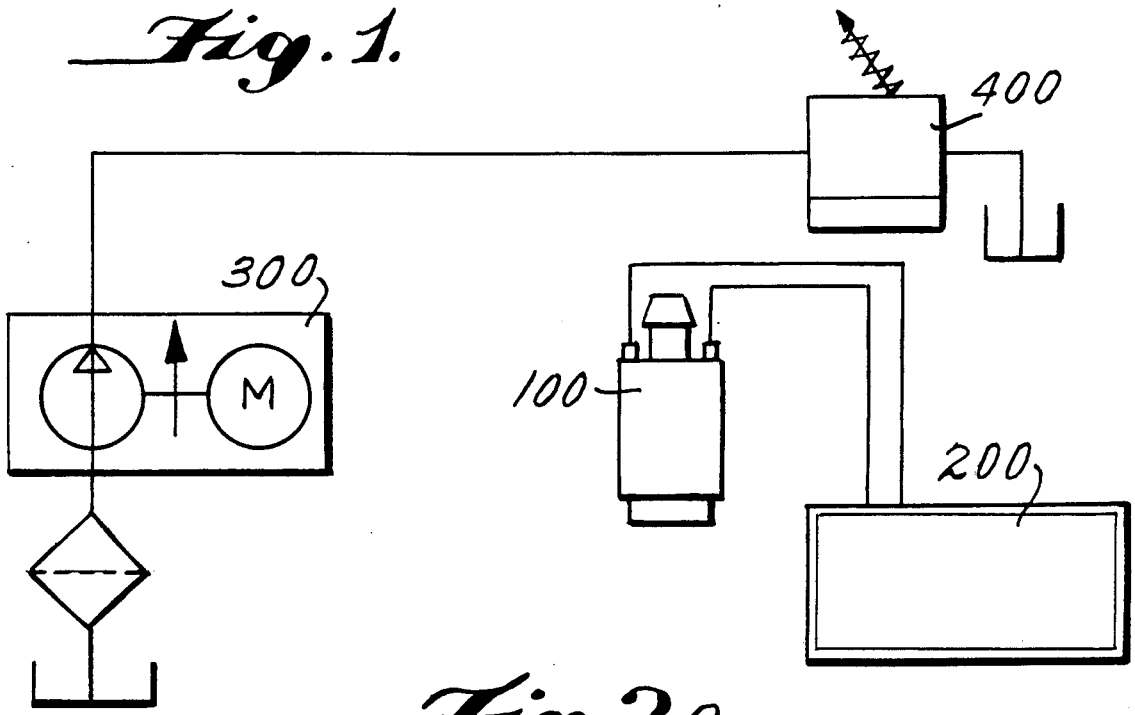
Fig. 2A.
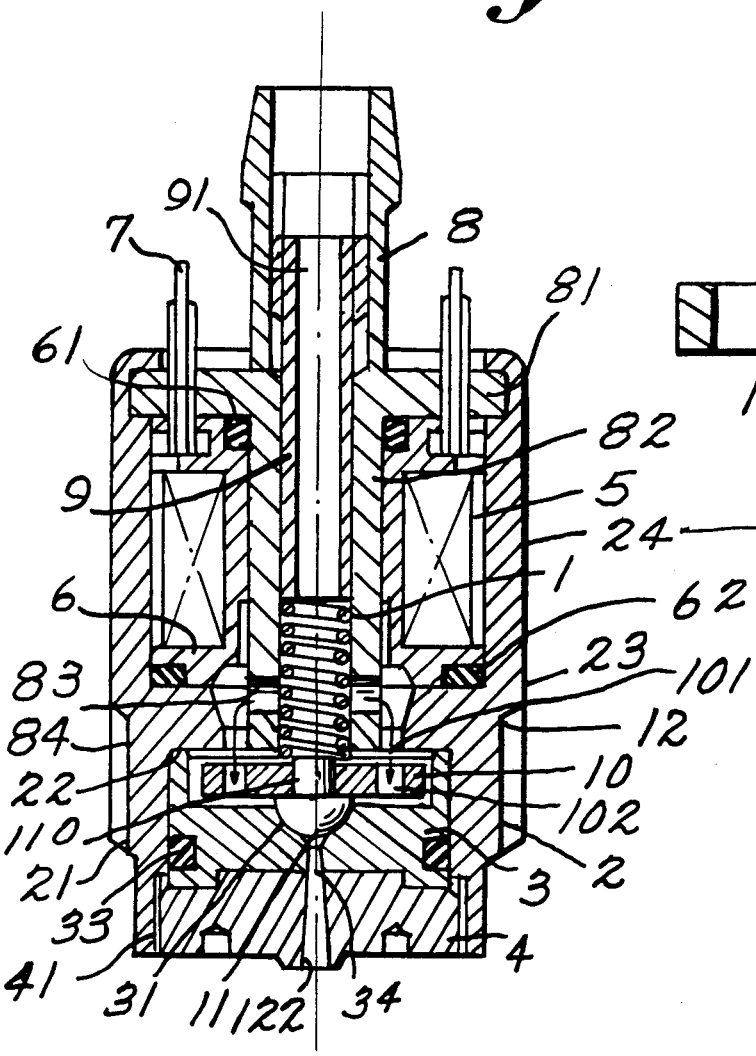
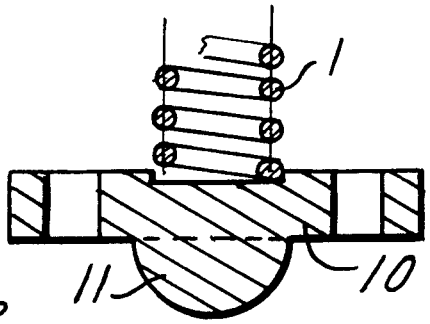
Fig. 2B.

FUEL OIL INJECTOR WITH A FLOATING BALL AS ITS VALVE UNIT

BACKGROUND OF THE INVENTION

The present invention relates to a fuel oil injector, more particularly, to a solenoid-operated injector for an electronically controlled fuel oil injection system, which serves a solenoid-operated injector to control fuel oil injection by means of moving a ball valve set.

The electronically controlled fuel oil injection system shown in FIG. 1 includes an injector 100 designed to have a solenoid-operated injector which serves to control the time of starting injection, the duration of injection and the time of stopping injection in response to a current pulse transmitted from an electronic control unit 200. As soon as the solenoid-operated injector is activated to the open position, fuel oil is injected under the pressure. As the solenoid valve is closed, fuel oil injection is stopped. As a result, the electronic control unit 200 can control the time for the injection start and stop, and, by controlling the duration of the current pulse, it can also control the injection volume q (cc/time) of fuel oil per cycle.

Fuel oil pressure is established by the fuel pump 300 and controlled by the pressure regulator 400.

At present, the injector applied to a gasoline engine injection system is mostly designed as a solenoid-operated injector. Such an injector is represented by U.S. Pat. No. 4,662,567. However, the idea of design for the valve assembly at its leading end is generally based upon the model of a diesel injector, including a valve needle and a valve body. The start/stop of fuel oil injection is controlled by means of a movement of the valve needle which is precisely fitted inside the valve body. Consequently, both the valve needle and the valve body must be manufactured with a high degree of precision and a resultant high cost, and, in particular, the deep and long inner hole of the valve body, as well as the cone in the deep hole, must be manufactured with very expensive, close tolerance machinery. Owing to that, the above-mentioned common injector has been an expensive element of the known fuel injection systems.

In addition, in common injectors, the processing error always causes different dynamic responses as the various valve bodies open or close; as a result, the injection volume per cycle fails to be maintained with accuracy, with specification injections doing the same.

SUMMARY OF THE INVENTION

In view of said defects found in the prior injectors, one object of the present invention is to provide a fuel oil injector. The injector provided controls the start/-stop of fuel injection by means of a movement of a ball valve rather than a valve needle in a valve body. The injector provided includes a small flat armature that is very smart and handy, easily manufactured with its cost being largely reduced. The flat armature used in the present invention can increase the magnetic flux area so as to obtain a stronger magnetic force to affect the ball valve, while also minimizing the moving mass whereby the dynamic response of injector may be improved. These are further objects of the present invention.

Another object of the present invention is to provide a relatively simple injector in comparison with the structures of the conventionally known injectors. In the event of difficulty, the injector of the present invention can be easily maintained.

A further object of the present invention is to provide a fuel oil injector having an adjustable spring pressure applied to the armature such that a delay is produced which corresponds to the delay caused by the opening and closing of the valve body, whereby the injection volume can be regularly maintained.

The present invention will become more readily apparent from the following description of the preferred embodiment of the present invention taken in conjunction with the accompanying drawings.

BRIEF DESCRIPTION OF THE DRAWINGS

FIG. 1 is an illustrative view of an electronically controlled fuel oil injection system.

FIG. 2A is a longitudinally sectional view showing the structure of the fuel oil injector of the present invention.

FIG. 2B is a cross-sectional view of the valve assembly of the present invention.

DETAILED DESCRIPTION OF THE PREFERRED EMBODIMENTS

Figure 3A:
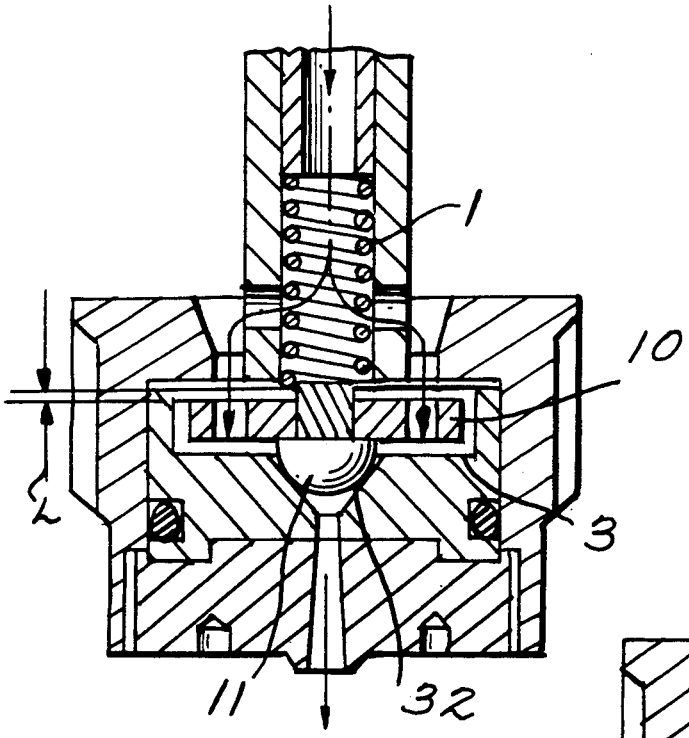
FIG. 3A is an illustrative view showing the closed state of the fuel oil injector of the present invention.

As shown in FIG. 2A, the fuel oil injector according to the present invention comprising: a magnetic coil assembly, a magnetic stator assembly which includes means for adjusting the spring load, a compression spring 1, a magnetic housing 2, a ball valve assembly, a valve seat 3, a screw block 4 and several O-rings, etc. The structure and functions of the accessories and parts are now illustrated as follows: The magnetic coil assembly including: a coil 5, a bobbin 6 and two terminals 7. As current flows through terminals 7 into coil 5, a magnetomotive $\epsilon$ results with $\epsilon = NI$ (wherein, N is number of coils and I is value of input current). This magnetomotive will form a magnetic flux circuit among the various magnetic materials. The bobbin 6 is provided for winding the enamelled wire to form a coil. The bobbin 6 and the insulated housing 71 of said terminal can be made of plastic materials.

The magnetic stator assembly includes a magnetic stator 8 and a spring adjusting tube 9. The magnetic stator 8 is made of a soft magnetic material. The magnetic flux circuit is thus formed by the shoulder portion 81, the center tube 82, the flat armature 10 and the magnetic housing 2. In addition, said spring adjusting tube 9 is accommodated in the enter tube 82, moreover, this adjusting tube 9 can move up and down in the center tube 82 by rotation of the tube 82 to adjust the compression spring force. Because the other end of the spring abuts against the end face 101 of the flat armature 10, the spring force upon that flat armature can be changed by moving the position of adjusting tube 9.

The ball valve assembly includes said flat armature 10 and a valve 11 having a ball-shaped leading end. The valve 11 may include a cylinder 110 formed at its rear end, which cylinder 110 is tightly accommodated in the center hole of the flat armature 10 so as to form said ball valve assembly. In addition, the cylinder 110 may also serve to position the inner hold of the compression spring 1. As mentioned above, because the flat armature 10 itself is also an element of the magnetic flux circuit, it should be constructed of a soft magnetic material, with multiple equipartition holes being formed therein as the fuel oil passages. Alternatively, the flat armature 10 can also be formed as one piece with the ball valve body. The flat armature 10 may also have a concave portion at its top end to facilitate fixing the compression spring 1 as shown in FIG. 2B.

When no current flows, the loading force from the spring pushes against the flat armature 10 and the leading end of the ball valve 11 tightly seats upon the cone 32 of the valve seat 3.

The valve seat 3 is installed in the central hole 21 at the leading end of said magnetic housing 2. A thin plate 12, having a high magnetic resistance such as stainless plate or a chrome plating layer, is provided between an end face of the valve seat 3 and the end face 22 of the positioning shoulder portion 23 of magnetic housing 2. The valve seat 3 and the thin plate 12 can be fixed at the end face 22 of the positioning shoulder portion 23 of magnetic housing 2 by means of driving a screw block 4 into place.

The pressurized fuel oil flows through the inner hole 91 of the spring adjusting tube 9 into the compression spring 1 and through the small hole 83 at the leading end of magnetic stator 8, through the multiple small holes 102 in the flat armature and finally fills the whole injector fully. The function of O-rings 61, 62, 33 is to prevent pressurized fuel oil from leaking from the interior of the injector.

When no current is flowing in the coil, the spring force causes the leading end of ball valve 11 to seat tightly against the cone 32 of the valve seat 3. As the surfaces of both the leading end of the ball valve 11 and the cone 32 of valve seat are fine ground, this spring forced seating provides a seal sufficient to prevent the pressurized fuel oil from leaking. When the terminals of both ends of the coil are connected with a power supply, the current flowing through the coil will gradually increase so as to form a magnetic flux circuit in the elements made of soft magnetic material, i.e., the magnetic flux will flow through the shoulder portion 81 of the magnetic stator, the center tube 82, over the gap between the end face 84 of the magnetic stator and the end face of flat armature 10, flow through the flat armature and over said thin plate 12 having a high magnetic resistance. Finally, the magnetic flux will flow through the end face 22 of the positioning shoulder portion 23 of the magnetic housing 2 and through the housing body 24 so as to form said magnetic flux circuit.

Figure 3B:
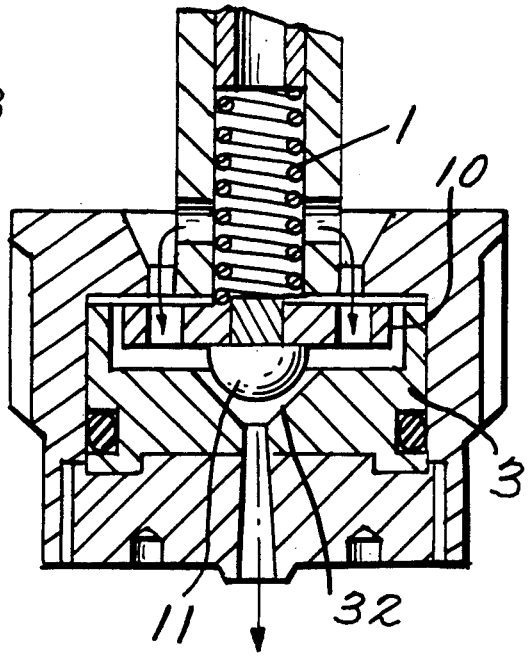
FIG. 3B is an illustrative view showing the open state of the fuel oil injector of the present invention.

As the magnetic flux increases, the flat armature 10 will be sucked toward the end face 84 of said magnetic stator 8 and the end face 22 of positioning shoulder portion 23 of the magnetic housing 2. The greater the current, the stronger the magnetic sucking force, until the spring-loaded force, acting on the flat armature 10 and pressure force caused by the static fuel oil is overcome. At that moment, the ball valve assembly starts to move and the ball valve 11 departs from the valve seat 3 and the pressurized fuel oil flows out of the gap formed between the ball valve 11 and the cone 32 of the valve seat 3 and through the small holes 31 in the center of that valve seat. After the ball valve assembly is sucked and moved, its flat armature 10 will be positioned against said thin plate 12 having a high magnetic resistance. At this point, the injector will be in a full open state as is shown in FIG. 3B, whereas the distance the ball valve assembly moves (we may refer to the distance as the lift L), is shown in FIG. 3A. Thus, the lift L is defined by the distance between the end face 101 of the flat armature 10 and the thin plate 12 when the ball's valve is in a closed state. Under the full open state, the flow injection rate (cc/min) is Q, while, $$Q\ A * \Delta p$$

A: Injection holes' sectional area

ΔP: Injection pressure

Therefore, Q is decided by the size of injection holes 122. After the injector opens, if the input current pulse is constantly maintained, the ball valve assembly will be kept at a full open state, and the injection volume $V = Q * \Delta t$, (66 t represents the duration of the current price) will be decided by the duration of the input current pulse.

As soon as the current pulse ends, the magnetic attractive force gradually disappears, and the compression spring pushes the ball valve assembly back against the valve seat 3 and the fuel injection will stop. To prevent the residual magnetic force from being too large and prohibit the ball valve assembly from rapidly being pushed back against the valve seat, the end face 22 of the positioning shoulder portion 23 of the magnetic housing is provided with a thin plate 12 having a high magnetic resistance. As the flat armature 10 is completely attracted, this thin plate forms an insulating gap between the end face of flat armature 10 and the end face 22 of the positioning shoulder portion 23. Once the input current pulse ends, this insulating gap reduces the residual magnetic force such that the ball valve assembly can be rapidly seated against the valve seat by the spring force and the fuel oil injection is ended.

As mentioned above, when current pulse is applied, the ball valve assembly will delay a certain period of time prior to shifting to the full open position. This delay is referred to as Open Delay T1. Once this current flow ends, the residual magnetic force and the inertia of the ball valve causes the ball valve assembly to delay a certain period of time prior to begin moving to the full close position. This delay is referred to as Close Delay T2. The main factors affecting Open Delay T1 and the Close Delay T2 are residual magnetic force, the inertia of the ball valve, which is increased with weight, and the lift L. With the application of the same spring loading force, the Open Delay T1 and the Close Delay T2 for the ball valve of each injector could be as varied as the ball valves themselves. This is caused by slight imperfections that may arise as each ball valve is manufactured. The variations may cause the fuel oil injection rate q(cc/times) to vary. However, with the design of the above magnetic stator assembly, the spring force acting on the ball valve assembly can be changed so as to minimize the effects caused by variations in the ball valve assembly. Thus, the injection volume 1 can be maintained with a certain accuracy, such as ±3%.

Figure 4:
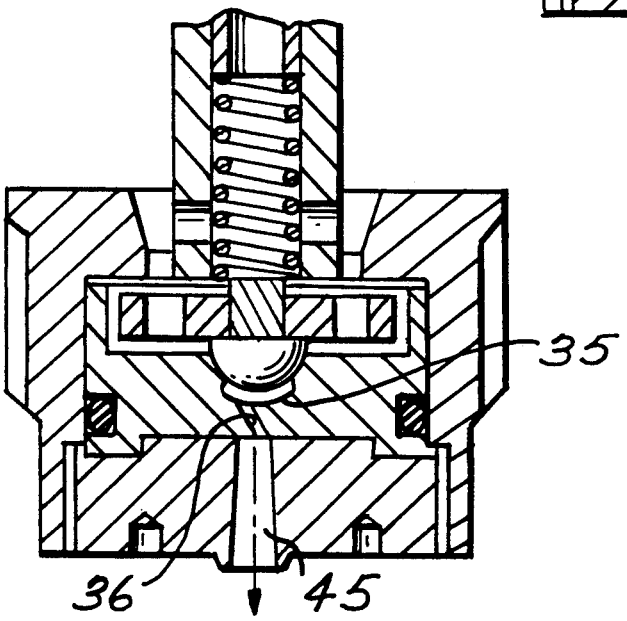
FIG. 4 is an illustrative view showing another example of ball valve assembly and valve seat of the present invention.

Referring to FIG. 2A, because the center of the valve seat is a single hole 34, the injected fuel oil will be in a single injection bundle with a small spray angle. Alternatively, in order to obtain a greater spray pattern, the design of the seat valve may adopt a fitting of a ball valve assembly an valve seat as shown in FIG. 4, with the central portion of the valve seat having a sink hole 35 with a ball curve rate. Moreover, the valve seat is drilled with several equipartitional oblique holes 36 through to the said ball sink hole 35. The weeping hole of these equipartitional oblique holes are formed in the central hole 45 of said screw block 4. Therefore, with the fuel oil flowing through said various oblique holes, several small injection bundles having horizontal flow distribution are produced. These various small injection bundles will be mixed in the center hole 45 and form a whirlpool action. The injected spray will not only have a great spray angle, but will also be caused to swirl by this whirlpool action. The spray angle will decide the drilling obliqueness of the various oblique holes.

In conclusion with the above-said descriptions, the features and advantages of the injector according to the present invention could be described as follow:

Referring to FIGS. 3, 4, the fitting between the ball valve assembly and the valve seat according to the present invention will enable the ball valve assembly to be in a floating state while opening and closing. Following being magnetically sucked into the full open state, the flat armature will abut against the thin plate having a high magnetic resistance. As the magnetic force disappears and the ball valve 11 closes, it will automatically seat on the oblique cone 32 of the valve seat so as to seal fuel oil. Based on the principle of said floating ball valve assembly, the ball valve assembly is not be required to fit with the valve seat with absolute precision and the manufacture of the ball valve assembly (including the flat armature and the ball valve), the valve seat and the fixed hole 21 can be completed with only general processing equipment. As a result, production costs can be reduced in comparison with the manufacture of conventional injectors having a valve needle and a valve seat. Moreover, because the position of the spring adjusting tube of the present invention can be changed accompanied by a result change of the spring force acting on the flat armature 10, variations in ball valve assembly opening and closing delay can be corrected, thereby maintaining fuel delivery accuracy for each injection cycle.

We claim:

1. A fuel injector for a gasoline engine comprising:

a magnetic housing having a leading end, a rear end, a central hole connecting said leading and rear ends and a shoulder portion disposed within said central hole between said leading and rear ends, wherein said housing is made of a soft magnetic material and said rear end is in communication with a pressurized fuel supply;

a magnetic coil assembly disposed within said magnetic housing central hole at the rear end of said housing, wherein said magnetic coil includes a central hole disposed coaxially with the magnetic housing central hole;

a magnetic stator assembly disposed within the central hole of said coil assembly;

a valve seat member having a hollow formed in a concave rear face and having an oblique cone leading to an injection nozzle disposed at a centermost portion thereof, disposed within the housing central hole at the leading end of said housing;

screw block means for securing said valve seat member rear face tightly against said shoulder portion of said housing;

a ball valve assembly disposed within said hollow formed in said valve seat member and having a semi-circular ball at a leading end and a flat armature at a rear end;

a nonmagnetic plate interposed between said housing shoulder portion and said valve seat member; and spring means biasing said ball valve assembly against said valve seat member whereby said semi-circular ball normally seats against said valve seat member oblique cone in a closed condition;

wherein said ball valve assembly is moveable to an open position in response to energization of said magnetic coil assembly whereby said pressurized fuel flows from said housing rear end, past said ball valve assembly, through said valve seat member oblique cone and through said injection nozzle.

2. A fuel injector as claimed in claim 1, wherein the spring means comprises a spring adjusting tube disposed within the central hole of the magnetic stator having a bottom end joined to a spring, a bottom end of the spring abuts against said plane armature.

3. A fuel injector as claimed in claim 1, wherein the flat armature is made of a soft magnetic material and the semi-circular ball is made of a hard material, said semi-circular ball having a curved surface at a leading end and a cylinder at rear end, said cylinder fits tightly in a central hole formed in said plane armature and is provided to fit an inner hole of said compression spring.

4. A fuel injector as claimed in claim 3, wherein the plane armature and the semi-circular ball are made in a one-piece body, with the plane armature having a concave compression spring fitting on a rear end thereof whereby the compression spring is held in place.

* * * * *